US007201027B2

(12) United States Patent
Gogel

(10) Patent No.: US 7,201,027 B2
(45) Date of Patent: Apr. 10, 2007

(54) LOCK GUARD WITH PROTECTIVE ROOF

(76) Inventor: Roy E. Gogel, Suite C-1, 319 Garlington Rd., Greenville, SC (US) 29615

( * ) Notice: Subject to any disclaimer, the term of this patent is extended or adjusted under 35 U.S.C. 154(b) by 0 days.

(21) Appl. No.: 11/336,484

(22) Filed: Jan. 20, 2006

(65) Prior Publication Data

US 2006/0201211 A1 Sep. 14, 2006

(51) Int. Cl.
*E05B 67/38* (2006.01)

(52) U.S. Cl. ..... 70/56; 70/203; 70/212

(58) Field of Classification Search ..... 70/54–56, 70/417, DIG. 43, DIG. 56, 202, 203, 211, 70/212; 292/DIG. 32, 148, 205, 218, 281, 292/283, 285; D8/334, 335, 346
See application file for complete search history.

(56) References Cited

U.S. PATENT DOCUMENTS

| | | | | |
|---|---|---|---|---|
| 626,266 | A * | 6/1899 | Bomberger | 70/56 |
| 1,220,941 | A * | 3/1917 | Bowers | 70/56 |
| 1,248,293 | A * | 11/1917 | Ellington | 70/56 |
| 2,114,913 | A * | 4/1938 | Crossman | 70/56 |
| 3,392,555 | A * | 7/1968 | Beaver | 70/56 |
| 3,828,591 | A * | 8/1974 | Beaver | 70/56 |
| 4,068,505 | A * | 1/1978 | Volk, Jr. | 70/56 |
| 4,566,296 | A * | 1/1986 | Kochakis | 70/56 |
| 4,882,918 | A * | 11/1989 | Stanich | 70/54 |
| 4,926,662 | A * | 5/1990 | Gaudet | 70/56 |
| 5,092,143 | A * | 3/1992 | Rumbles | 70/56 |
| 5,118,149 | A * | 6/1992 | Emmons | 292/327 |
| 5,172,574 | A | 12/1992 | Perfetto | 70/56 |
| 5,735,147 | A * | 4/1998 | Cattanach et al. | 70/164 |
| 6,494,064 | B1 * | 12/2002 | Pena | 70/56 |
| 6,915,670 | B2 | 7/2005 | Gogel | 70/32 |
| 6,983,629 | B1 | 1/2006 | Gogel | 70/14 |
| 7,003,989 | B2 * | 2/2006 | St. James | 70/56 |
| 2004/0107744 | A1 * | 6/2004 | Chen | 70/2 |

* cited by examiner

*Primary Examiner*—Lloyd A. Gall
(74) *Attorney, Agent, or Firm*—Charles L. Schwab; Nexsen Pruet, LLC

(57) ABSTRACT

A security device is provided for locking a closure such as a door or a gate to an enclosure. The security device is a lock guard for a padlock having a shackle insertable in either a vertical opening or a horizontal opening in a latch component on the closure or the enclosure. The lock guard has a sloping roof for deflecting sledge hammer blows. The sloping roof is preferably a double pitch roof. One embodiment of the invention has two double pitch roofs facilitating its use with both latch parts having vertical openings and latch parts having horizontal openings. Another embodiment of the invention has a single pitch roof.

8 Claims, 6 Drawing Sheets

LOCK GUARD WITH PROTECTIVE ROOF

RELATED APPLICATIONS

Applicant claims the benefit of U.S. patent application Ser. No. 11/230,677 filed Sep. 20, 2005 for a Stanchion Lever Lock Guard and the benefit of U.S. provisional patent application Ser. No. 60/612,328 filed Sep. 23, 2004 for a Lock Guard, to which the first mentioned application claimed benefit.

BACKGROUND OF THE INVENTION

Thieves who break into moving vans, tractor trailers and other cargo containers use a variety of tools such as sledge hammers, acetylene cutting torches, saws, grinders and the like. The bolt cutter is a favored tool of burglars for cutting padlocks because of its portability and reduced time, light and sound generation. Thus there is a need to protect padlocks used on containers, moving vans, semi-trailers, truck trailer units and storage facilities. Tractor trailers with twin rear doors are secured by a pair of stanchions, at least one of which has an operating handle or lever, which is normally secured by a padlock to prevent rotation of the stanchion, thus maintaining the doors in a locked condition. Many moving vans have side doors, which are also secured by stanchions. A recess with a locking tab is provided in each side door. The stanchion locking lever, in its locking position, is disposed within the recess with the locking tab extending through a slot in the lever. A padlock is customarily connected to the tab to prevent operation of the stanchion lever. It is also desirable to provide protection for padlocks securing doors of containers or storage facilities and for padlocks fastened to door or gate securing clasps or latches.

SUMMARY OF THE INVENTION

This invention is directed to a lock guard, which prevents bolt cutters or the like from being employed to cut the shackle of a padlock. It also has a pitched roof with substantially planar exterior surfaces designed to deflect sledge hammer blows. The lock guard has a front wall, and a side wall structure extending rearwardly from the front wall with a gap at the bottom of the front wall. The walls define a cavity for a padlock; and an interior tab extends rearwardly from the front wall with an opening through which a padlock shackle passes when the latter is in its installed locking condition. In the installed position of the padlock the shackle is shielded by the top, front and side walls of the housing, and the back side of the padlocks is shielded by the door itself. Only the key end of the padlock casing is exposed at the open bottom of the protective shell formed by the walls and the door. One embodiment of the invention provides a lock guard constructed to present a double pitched roof in each of two positions of the lock guard and the accompanying padlock.

BRIEF DESCRIPTION OF THE DRAWINGS

The invention is illustrated in the accompanying drawings, in which.

DETAILED DESCRIPTION OF THE INVENTION

Figure 2:
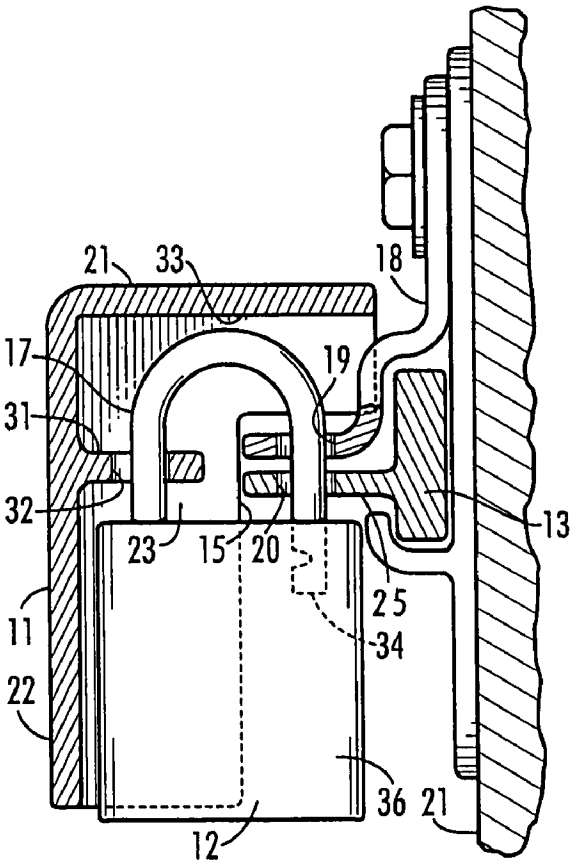
FIG. 2 is a vertical section of the lock guard shown in FIG. 1 applied to a padlock securing a stanchion operating lever having a right angle reinforcing ridge.
Figure 1:
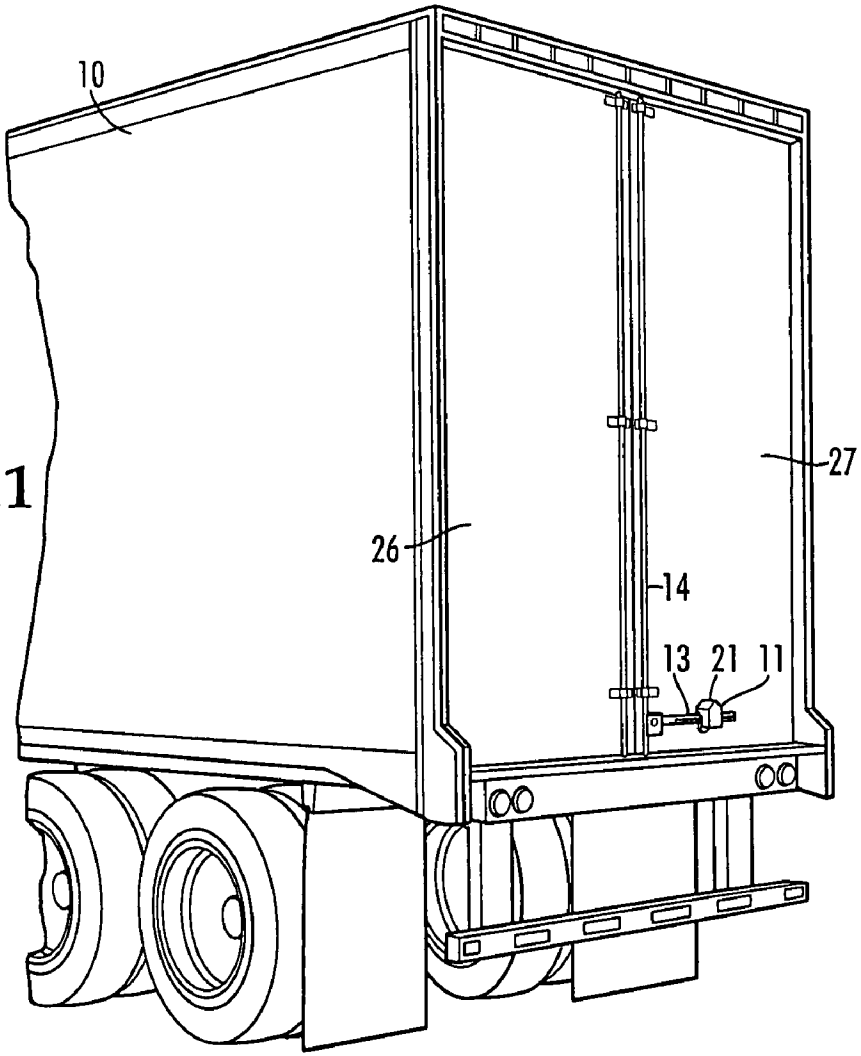
FIG. 1 is a perspective view of the rear end of a tractor-trailer showing one embodiment of a lock guard with a double pitch roof protecting a padlock securing the operating lever of one of the locking stanchions.

The lock guard 11 shown in FIGS. 1 and 2 is used with a padlock 12 securing an operating lever 13 of a stanchion 14 for closures in the form of rear doors 26,27 of a semi-trailer truck container 10. The operating lever 13 has a reinforcing ridge 25 with an opening 20 for receiving the shackle 17 of the padlock 12. A pivotable keeper 18 also has an opening 19 for the shackle 17. The lock guard 11 has a top wall in the form of a double pitched roof 21, a front wall 22 and a pair of laterally spaced parallel side walls, only wall 23 of which is shown. The vertically extending side walls have notches 15 to accommodate reinforcing ridge 25 on the stanchion operating lever 13. A retainer tab 31 is welded to the side walls and to the backside of the front wall 22 and extends horizontally at a right angle to front wall 22. The tab 31 has an appropriately sized opening or bore 32 to accommodate the U shaped shackle 17 of the padlock 12. An abutment surface 33 on the underside of the roof 21 serves as an abutment when locking the padlock 12. When installing the padlock 12 and the lock guard 11, the padlock 12 is unlocked, in which condition the U shaped shackle 17 is extended from the case 36 of the lock 12 to an open position, not shown. The free or distal end 34 of the shackle 17 is passed through the opening 32 in the retainer tab 31 of the lock guard 11. The lock guard 11 and padlock 12 are then moved toward the door 27 being secured and the free end 34 of the shackle 17 is passed through an opening 19 in a pivotable keeper 18 and the opening 20 in the ridge 25 of the lever 13. The padlock 12 is then locked, as shown in FIG. 2, by placing the shackle 17 against the abutment surface 33 and forcing the end 34 of the shackle 17 into the case 36.

Figure 3:
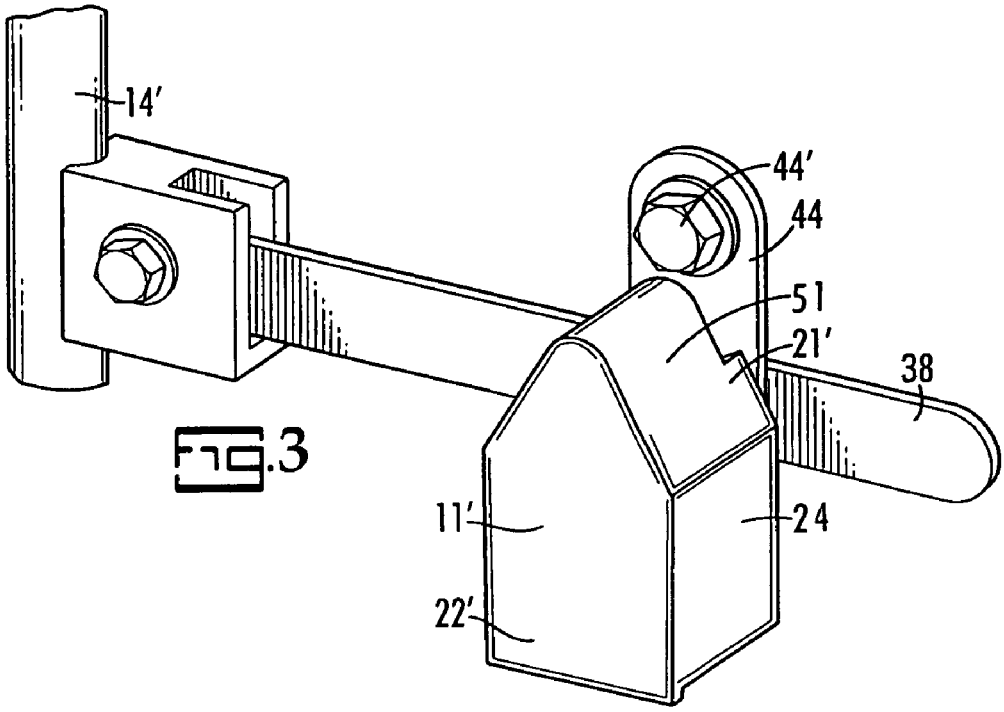
FIG. 3 is a perspective view of a second embodiment of the lock guard.
Figure 4:
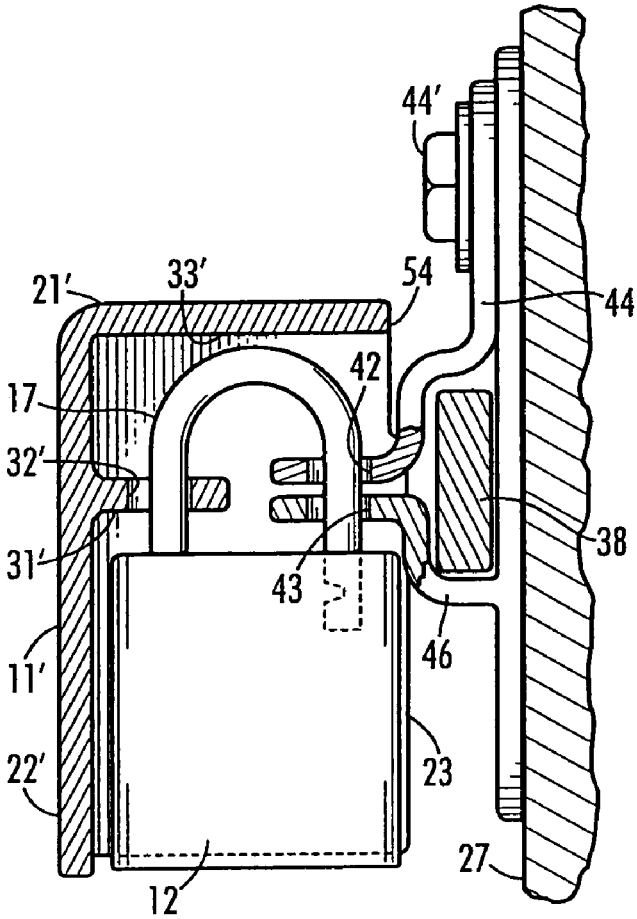
FIG. 4 is a vertical section showing the lock guard of FIG. 3 applied to a padlock securing a pair of operating lever keepers for a stanchion operating lever which does not have a right angle reinforcing ridge.
Figure 5:
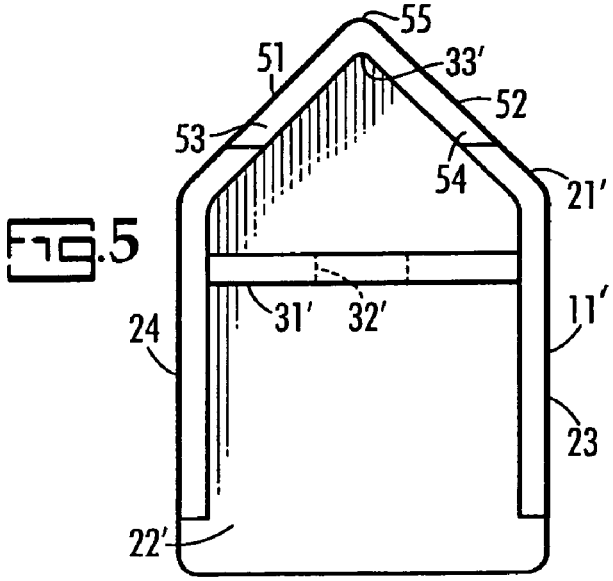
FIG. 5 is a rear view of the lock guard shown in FIGS. 3 and 4.

Some stanchion locking levers do not have a reinforcing ridge. Such a locking lever 38 is shown in FIGS. 3, 4 and 5, with FIG. 3 showing it pivotally connected to a stanchion 14'. A second embodiment lock guard 11', shown in FIGS. 3, 4 and 5, is used to secure the locking lever 38. The lock guard 11' includes, a front wall 22', a tab 31', a pair of parallel side walls 23, 24 and a double pitch roof 21' with a peak 55 extending in a front to rear direction. Notches 53, 54 are formed in the side walls 23, 24 to accommodate the upper pivotable keeper 44. As shown in FIG. 4, the shackle 17 of the lock 12 is passed through opening 32' in the tab 31' and through aligned openings 42, 43 in the keepers 44, 46. The lock 12 is secured by abutting the shackle 17 against the abutment surface 33' on the underside of the double pitch roof 21'. As shown in FIG. 5, the double pitched roof 21' has right and left planar parts 51, 52 which slope upward toward one another from the side walls 23, 24, at equal angles to the side walls 23, 24, peaking in a slightly rounded peak 55 midway between the side walls 23, 24. The roof segments 51, 52 have substantially planar exterior surfaces and are notched at 53, 54 to accommodate the upper keeper 44 and its fastener 44' which may not always be of the exact same configurations. The front wall 22' is slightly longer than the side walls 23, 24 so as to extend below the lower ends of the side walls 23, 24.

Figure 6:
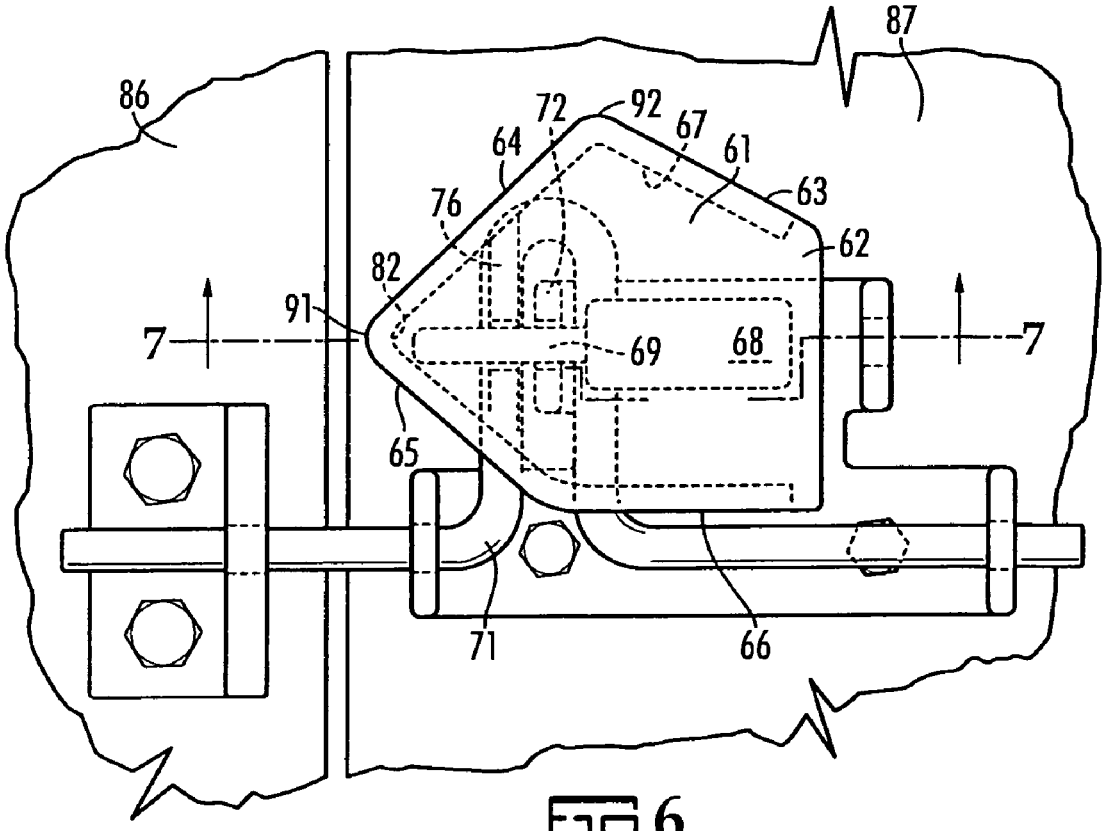
FIG. 6 is a view showing a third embodiment lock guard having a top and a side with angled walls forming peaked roofs for deflecting sledge hammer blows.
Figure 7:
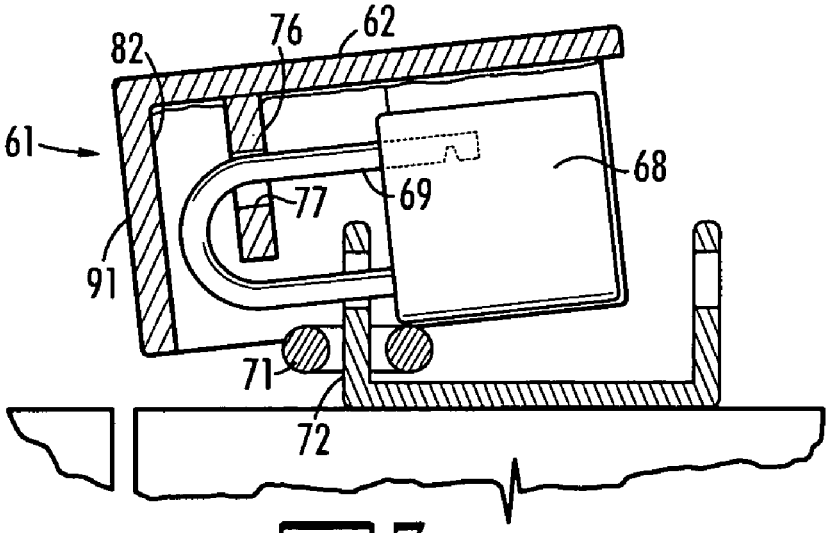
FIG. 7 is a section taken on line 7—7 in FIG. 6.
Figure 8:
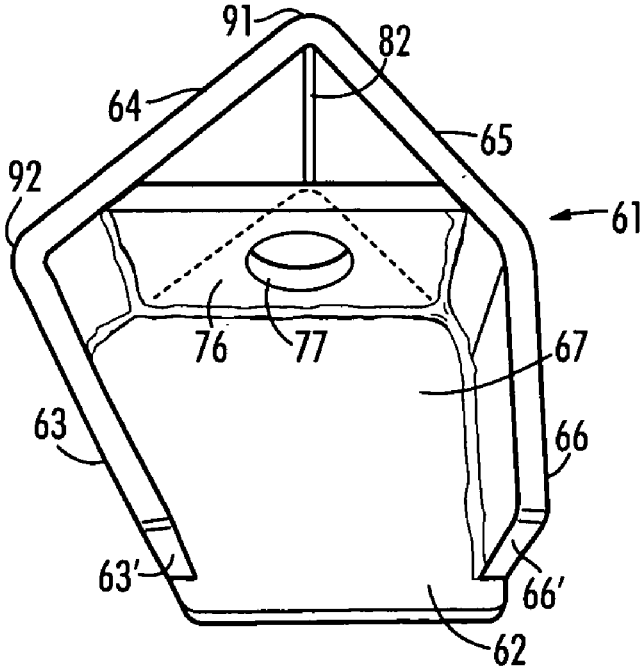
FIG. 8 is a rear perspective view of the locking guard shown in FIGS. 6 and 7.
Figure 9:
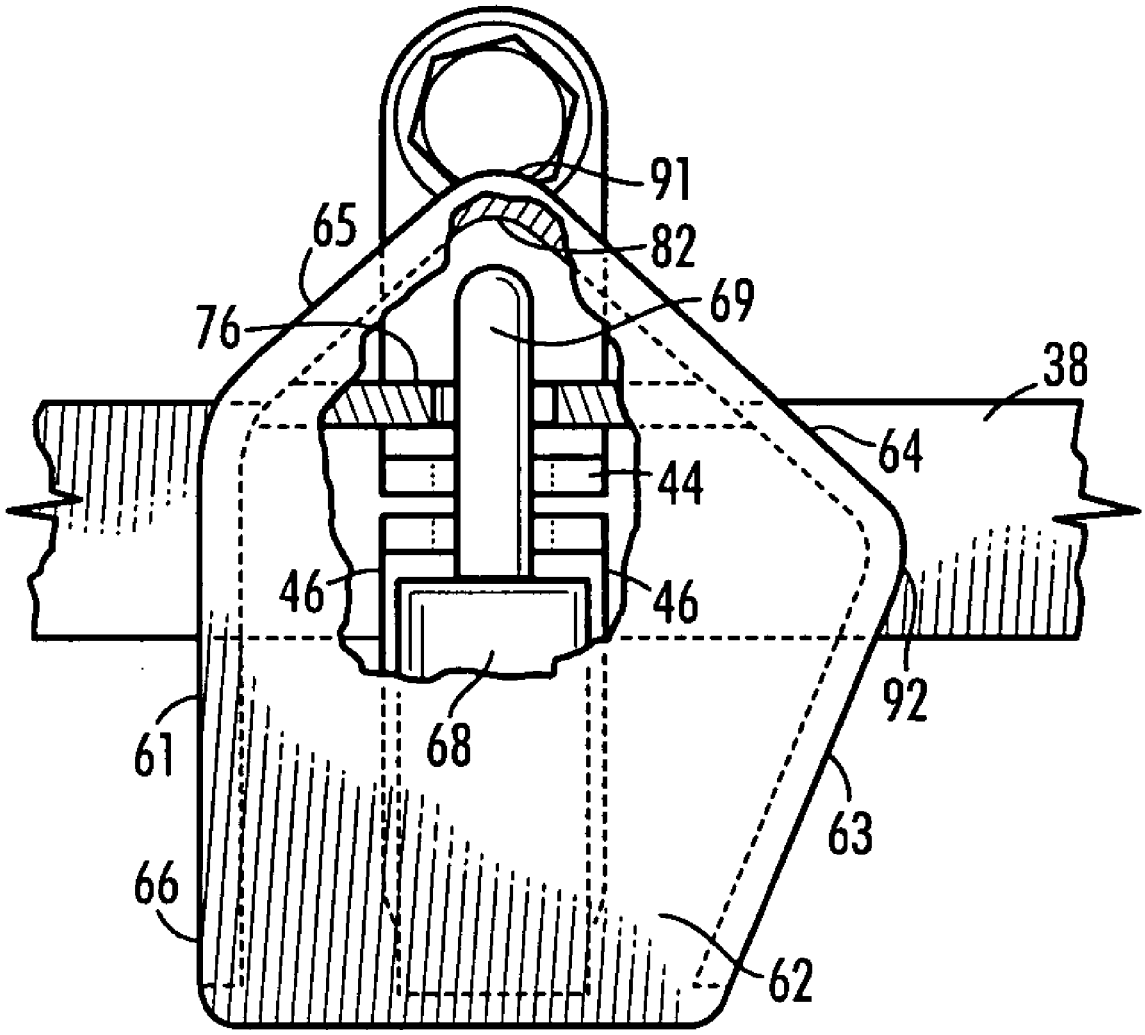
FIG. 9 shows the lock guard of FIGS. 8, with parts broken away, securing a stanchion operating lever of the type shown in FIGS. 3 and 4.

FIGS. 6 through 9 illustrate a third embodiment of the invention which affords protection for a padlock 68 connected to either horizontally extending latch parts with vertical holes such as shown in FIGS. 2, 4 and 9 or a vertically extending latch part 72 as shown in FIGS. 6 and 7. The lock guard 61 of FIGS. 6, 7, 8 and 9 has a flat vertically extending front wall 62 and interconnected side walls 63, 64, 65, 66, with planar exterior surfaces, forming a protective chamber or cavity 67 for a padlock 68. The side wall structure has a gap between the ends 63', 66' of the walls 63, 66 thereby creating a side opening in the cavity 67 which facilitates installing the padlock 68 to either a horizontal or vertical latch. The walls 63, 64 form a first double pitch roof for protecting the padlock 68 from downward directed sledge hammer blows when the lock guard 61 is installed on a latch arrangement such as shown in FIGS. 6 and 7 wherein a vertically extending latch segment 72 is locked to a horizontally shiftable bolt 71 by the padlock 68. The horizontally shiftable bolt 71 locks a door 86 to an enclosure 87.

The side walls 63, 64 of the lock guard 61 form a first double pitch roof, with planar exterior surfaces, when locking an enclosure having a vertically extending latch part, such as latch segment 72; and the side walls 64, 65 form a second double pitched roof, with planar exterior surfaces, protecting the padlock 68 against vertically downward blows when the lock guard 61 and padlock 68 are applied to a horizontally disposed latch part or parts, such as the keepers 44, 46 for the stanchion lever 38 shown in FIG. 9. The side wall 64 is shared in common by the first and second double pitched roofs. The lock guard 61 includes a tab 76 with a round opening 77. The tab 76 is welded at its opposite ends to the walls 64, 65, respectively, and has one edge welded to the back side of the front wall 62. The lock guard 61 includes an abutment surface 82 which engages the shackle 69 of the lock 68 when the latter is installed as shown in FIGS. 6, 7 and 9. A slightly rounded peak 92 is formed at the junction of the walls 63, 64, which form the first double pitch roof; and a second double pitch roof, formed by sides 64, 65, has a slightly rounded peak 91. Both peaks 91. 92 extend in a front to rear direction.

Figure 10:
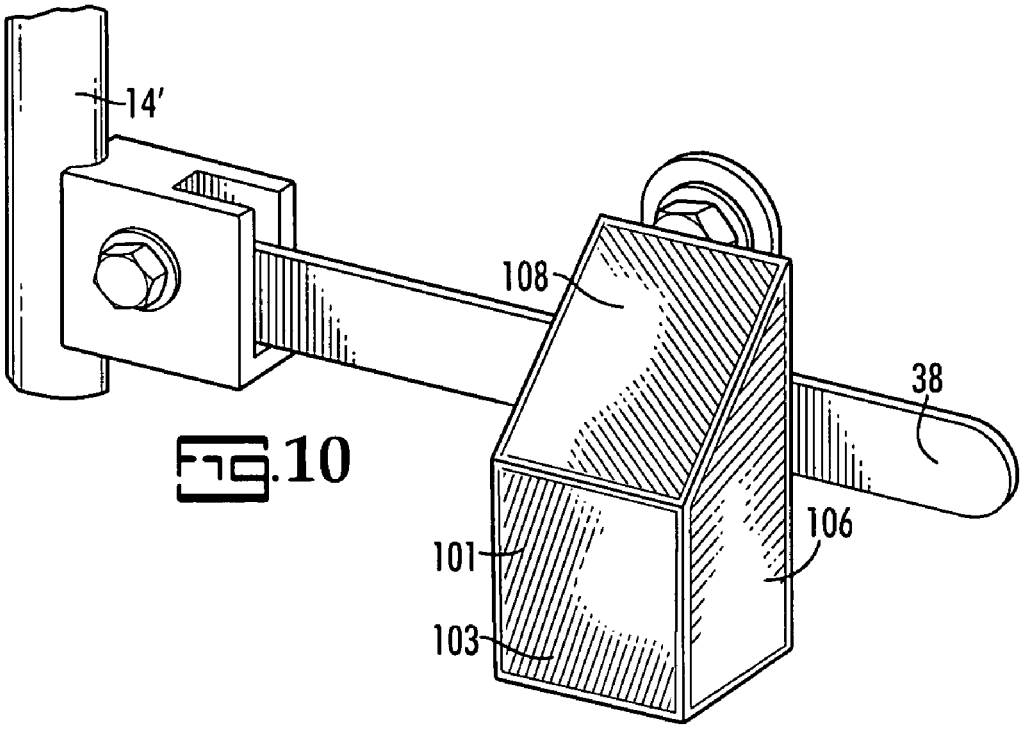
FIG. 10 is a perspective view showing a lock guard with a roof sloping upwardly and rearwardly from its front wall.
Figure 11:
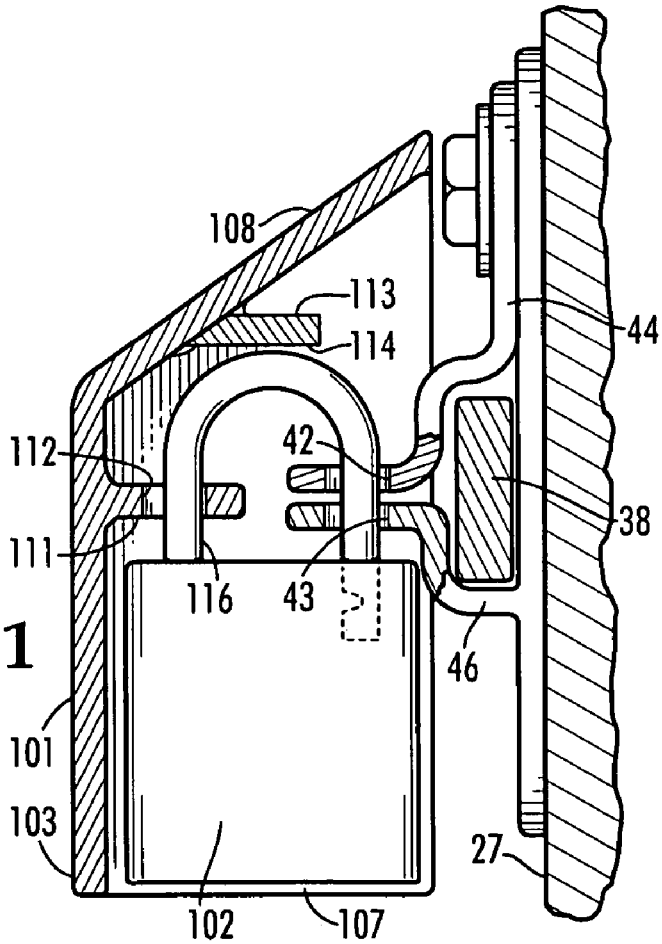
FIG. 11 is a vertical section of the lock guard of FIG. 10.

A fourth embodiment of the invention is shown in FIGS. 10 and 11, showing a lock guard 101 protecting a padlock 102 locking the keepers 44, 46 which secure the operating lever 38 of the stanchion 14'. The lock guard 101 has a vertical front wall 103 and a rigidly interconnected side wall structure extending rearwardly from the top and laterally opposite edges of the front wall 103 including laterally opposite side walls 106, 107 and a roof 108 which slopes upwardly and rearwardly from the top of the front wall 103. A horizontally disposed locking tab 111 with a vertical opening 112 is rigidly secured to the back side of the front wall 103. An abutment 113 is rigidly secured to the underside of the roof 108 and presents an abutment surface 114 against with the shackle 116 is engaged when locking the padlock 102. The locking tab 111 and the abutment 113 are also rigidly secured to the side walls 106, 107. The front wall 103, the side walls 106, 107 and sloping roof 108 from a protective cavity for the padlock 102 and the sloping roof 108 defects sledge hammer blows of vandals.

A versatile low cost lock guard is provided for protecting padlocks securing doors; gates, cargo containers and the like. The lock guard has a sloping roof with substantially planar exterior surfaces which effectively deflect sledge hammer blows. One embodiment of the lock guard has a single double pitch roof and a second embodiment of the invention has two double pitch roofs. The last mentioned embodiment protects a padlock when used to secure either horizontally or vertically disposed latch parts having corresponding vertically and horizontal openings engageable by the shackle of an appropriately sized padlock. In all the illustrated lock guards except the lock guard shown in FIGS. 10 and 11. The peaks of the roofs extend in a front to rear direction.

What is claimed is:

1. A security device for locking a container closure to a component of the container which has an opening for reception of an unhinged leg of a shackle of a padlock, said security device comprising:

a lock guard including a vertical front wall, a side wall structure including interconnected side walls extending rearwardly from the top and laterally opposite side of said front wall, said side wall structure forming a double pitch roof at the top of said lock guard with roof segments having planar exterior surfaces, said front wall and said side wall structure forming a protective cavity for said padlock, and a locking tab rigidly secured to said front wall and said side wall structure and extending rearwardly from an intermediate part of said front wall including an opening for receiving said shackle of said padlock, a hinged leg of said shackle being disposed in said opening in its locked position.

2. The security device of claim 1 including an abutment surface on the underside of said roof against which said shackle of said padlock is engaged to force said shackle to its locked position.

3. The security device of claim 1 wherein said side wall structure forms a second double pitch roof in one of said laterally opposite sides, said second double pitch roof having segments with planar exterior surfaces.

4. The security device of claim 3 including an abutment surface in said lock guard cavity against which said shackle of said padlock is engaged to assist said shackle to its locked position.

5. A security device for locking a container closure to a component of the container which has an opening for reception of a shackle of a padlock, said security device comprising:

a lock guard including a vertical front wall, a side wall structure including interconnected side walls extending rearwardly from the top and laterally opposite sides of said front wall, said side wall structure forming a first double pitched roof at the top of said lock guard and a second double pitched roof at one of its laterally opposite sides, said front wall and said side wall structure forming a protective cavity for said padlock, each of said roofs having roof segments with planar exterior surfaces and a peak extending in a front to rear direction, said first and second roofs sharing a roof segment in common and a locking tab secured to said front and side walls and extending rearwardly from an intermediate part of said front wall, said locking tab having an opening for receiving said shackle of said padlock.

6. The security device of claim 5 including an abutment surface in said lock guard cavity against which said shackle of said padlock is engaged to assist said shackle to its locking position.

7. A security device for locking a door for an enclosure to a component of the enclosure which has an opening for reception of an unhinged lea of a shackle of a padlock, said security device comprising:

a lock guard including a vertical front wall, a pair of parallel vertical side walls rigidly secured to and extending rearwardly from laterally opposite sides of said front wall, said a roof with an exterior upward facing planar surface sloping upwardly and rearwardly from the top of said front wall, said front wall, said roof and said side walls being rigidly interconnected to form a protective cavity for said padlock, and a horizontally extending locking tab rigidly secured to and extending rearwardly from said front wall including an opening for receiving the hinged leg of said shackle of said padlock.

8. The security device of claim 7, including an abutment in said lock guard cavity rigidly secured to said roof against which said shackle of said padlock is engaged to force said shackle to its locking position.

* * * * *